United States Patent [19]

Haran et al.

[11] Patent Number: 4,521,768

[45] Date of Patent: Jun. 4, 1985

[54] INTRUSION DETECTOR

[75] Inventors: Ilan Haran; Dan Haran, both of Ramat Gan, Israel

[73] Assignee: Elsec Electronic Security Systems Ltd., Givataim, Israel

[21] Appl. No.: 366,558

[22] Filed: Apr. 8, 1982

[51] Int. Cl.[3] ..... G08B 13/00

[52] U.S. Cl. ..... 340/566; 340/526; 340/529

[58] Field of Search ..... 340/529, 530, 566, 526

[56] References Cited

U.S. PATENT DOCUMENTS

| | | | |
|---|---|---|---|
| 3,691,549 | 9/1972 | Wilson | 340/566 |
| 3,828,338 | 8/1974 | Kato | 340/529 |
| 3,831,039 | 8/1974 | Henschel | 340/526 |
| 3,978,479 | 8/1976 | Schmitz | 340/529 |
| 3,979,740 | 9/1976 | Forbat et al. | 340/529 |
| 4,136,334 | 1/1979 | Seifers | 340/529 |
| 4,365,239 | 12/1982 | Mongeon | 340/526 |
| 4,386,343 | 5/1983 | Shiveley | 340/529 |

*Primary Examiner*—Stewart J. Levy
*Assistant Examiner*—John E. Chapman, Jr.
*Attorney, Agent, or Firm*—Browdy and Neimark

[57] ABSTRACT

An intrusion detection system which reliably detects intrusions while minimizing false alarms by time-analyzing significant signals indicative of intrusions. The time length of each significant signal is measured, the time lengths of successive significant signals are accumulated, and an intrusion signal is generated if the accumulated time length reaches a first preselected time length. The time length between successive significant signals is also measured, and the accumulated time length is reset to zero if the time length between successive significant signals reaches a second preselected time length.

1 Claim, 4 Drawing Figures

INTRUSION DETECTOR

FIELD OF THE INVENTION

This invention is concerned with intrusion detection equipment and more particularly with intrusion detection equipment that minimizes false alarms.

BACKGROUND OF THE INVENTION

Intrusion detection equipment is intended to protect closed areas against intrusion to prevent vandalism and/or burglary. There are many types of intrusion detectors available at the present time which use different detection sensors. There are capacitor type detectors, there are sonic detectors, vibration detectors and acoustic intrusion detections, among others. Acoustic intrusion detectors analyse the surrounding noises in protected areas to detect any unusual patterns such as would be generated by intruders. All of the systems presently available suffer because of "false alarms" generated by inherent conditions and not by intruders.

There are no known intrusion detectors on the market which identify intrusions by analysing the pattern of the detected signal in the protected areas.

There are currently available security systems based on remotely controlled listening devices where noise analysis is done by the operator listening to the noise. However there are no analysis and decision circuits located within the detection equipment itself.

A major reason for the non-availability of detectors incorporating analysis and decision circuits is that it is believed by those skilled in the art that such detectors show a high false alarm fate due to random non-relevant noises. False alarms are a cause of low reliability and even gradual loss of sensitivity.

Available intrusion detector systems using acoustic detectors are an example of vulnerability to false alarms. Strong short duration noises such as engine "back-fire" or supersonic booms tend to trigger such detectors unless its sensitivity is set to be far below the sensitivity needed to detect an intrusion.

SUMMARY OF THE INVENTION

The low false alarm rate acoustic intrusion detector features innovative analysis and decision circuits virtually eliminating the adverse effects of such random non-relevant noises. The system analyses the time periods of noises that are higher than a specified amplitude. Normal background noise effects are minimized since the detector sensitivity threshold is set above the average normal noise level in the protected area.

The analysing circuiting marks and remembers the accumulated time period of noises that have passed the threshold level, herein referred to as "significant noises". The detector does not declare an alarm until the accumulated time period has reached a pre-programmed amount. For example, the accumulated time period can be programmed to one out of four time periods, such as 4, 8, 16 or 32 seconds. In case no noises above the sensitivity level (significant noises) have been recorded during a continuous period of 65 seconds, for example—the register holding the accumulated "significant noises" for the time period is cleared since what has been accumulated is considered to be non-relevant or a "false alarm". Every significant noise restarts the count of the 65 seconds period. The combination of analysing only significant noises and of accumulating of the time length of the significant noises makes the detector immune to short, very strong, non-periodical noises, enables retention of high sensitivity to continuous intrusion noises (as drilling, speaking, etc.).

BRIEF DESCRIPTION OF THE DRAWINGS

The operation and utilization of the present invention will be more fully apparent from the description of a preferred embodiment taken in conjunction with the following drawings, in which.

GENERAL DESCRIPTION

Figure 1:
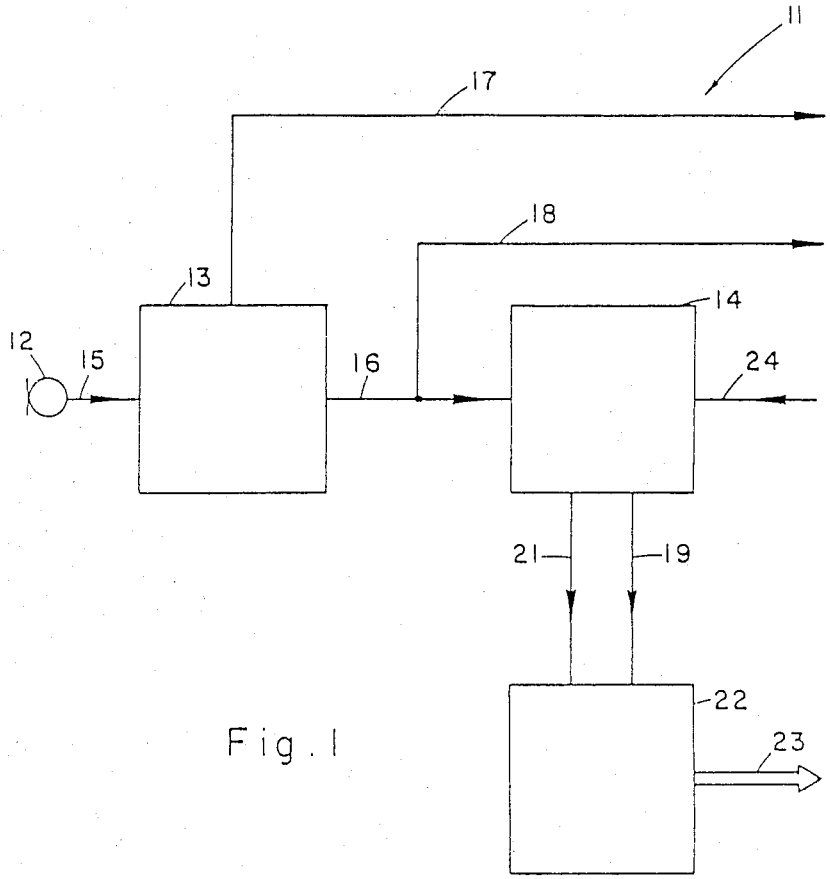
FIG. 1 is a block diagram of an exemplary acoustic intrusion detector system.

The acoustic intrusion detector system 11 of FIG. 1 comprises detecting means for detecting noise changes of ambient conditions which may indicate intrusion, such as, for example, microphone 12 which detects noises. The output of microphone 12 is coupled into a significant noise sensing circuit 13 over conductor 15. The output of the significant noise sensing circuit 13 is connected to a noise analysis and alarm signal circuit 14 over conductor 16. There is an audio output on conductor 17 shown coming from the significant noise sensing circuit 13. There is also a monitoring conductor 18 connected to conductor 16.

The output of the analysis circuit 14 is coupled through either an alarm conductor 19 or alarm delay conductor 21 to output interface circuitry 22. The output interface circuitry provides a plurality of different types of outputs indicated by bus 23. The noise analysis circuit also has an external sensor input connected through conductor 24.

In operation the microphone 12 picks up almost all noises in the enclosed area. The excessive noise sensing circuit 13 determines whether or not the noise is significant, that is whether or not it is above a certain predetermined threshold limit. If it is then the noise is analyzed by the noise analysis circuit 14. The noise analysis circuit measures the time length of any noise that has been determined to be significant. It accumulates the measured time length of significant noises and when the accumulated time reaches a preset amount, an alarm signal is generated. The alarm can be visual or audio. It can operate an automatic dialler for example to call the police or use any of the alarms well known to those skilled in the art. The alarm signal output is sent to an interface circuit which outputs the alarm signal to a particular type of alarm selected for the system.

Figure 2:
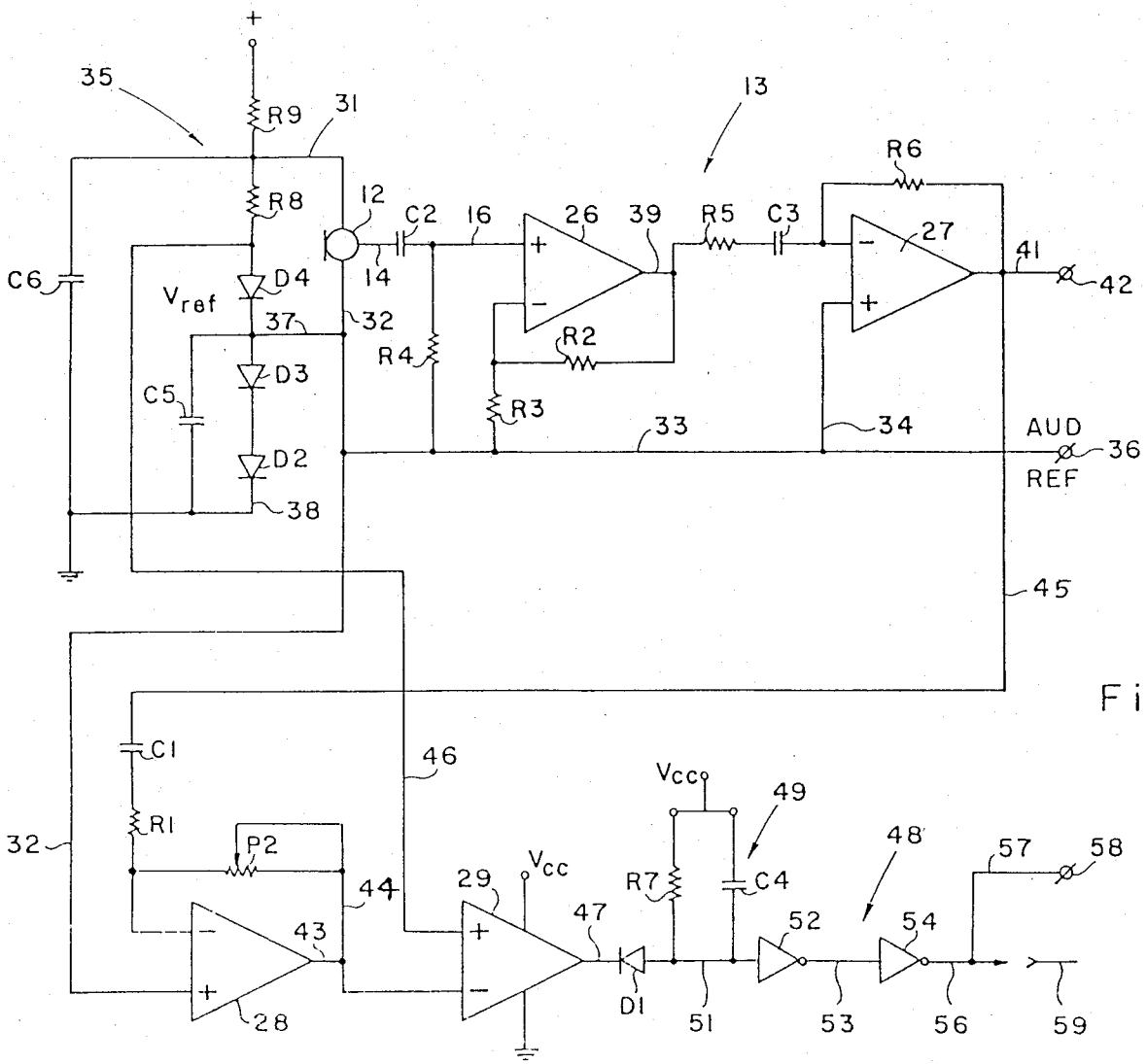
FIG. 2 is a schematic diagram of the significant noise sensing circuitry of FIG. 1.

In a preferred embodiment the significant noise sensing circuitry as shown in FIG. 2 comprises amplifying means and comparator means. The amplifying means is shown as including three operational amplifiers 26, 27 and 28. The comparator is shown as an operational amplifier connected in as a comparator 29.

Microphone 12 in the preferred embodiment is an omnidirectional electric condenser microphone having a sensitivity better than $-70$ DB (below 1 volt/$\mu$ bar at 1 KHz). Such microphones are available commercially as Rubicon type No. RM 72y.

The microphone 12 is shown as a three conductor type including conductor 14 leading to the first amplifier 26. The second conductor 31 is connected to positive voltage through resistor R9 for biasing purposes. A capacitor C6 is attached from the positive supply through the resistor R9 to ground for filtering purposes. The other conductor 32 of the microphone is connected to a main reference voltage source.

Voltage reference source means are provided such as shown generally at 35. Therein three diodes D2, D3 and D4 are shown serially connected between ground and current limiting resistor R8. The other end of resistor R8 is coupled through resistor R9 to positive voltage.

The string of diodes form two reference voltages. The voltage drop on diodes D2 and D3 in series provide the "common" or main reference voltage for the microphone amplifiers. The connection point of diodes D4 and D3 is connected through conductor 37 to conductor 32 of the microphone. The "common" formed at the junction of diodes D3 and D4 is connected by conductor 32 to conductor 33. Conductor 33 is coupled to the input of a first amplifier by resistor R3, conductor 33 is coupled by conductor 34 to the positive input of the second amplifier 27. The main reference voltage is coupled by conductor 32 to the positive input of the third amplifier 28. Filter capacitor C5 is connected across the diodes D2 and D3. Diode D2 is coupled through conductor 38 to ground.

A second reference voltage is provided. The voltage drop on diode D4 forms the second reference voltage which is slightly above the main reference voltage. In the preferred embodiment the second reference voltage is 0.6 volts above the main reference voltage. The second reference voltage is used for the comparator.

In a preferred embodiment all three microphone amplifiers and the comparator come in a single integrated circuit uA324 which consists of four separate operational amplifiers. In the preferred embodiment the first amplifier 26 is shown connected in a non-inverting mode to obtain high input impedance. The output of microphone 12 is coupled through conductor 14, coupling capacitor C2 and conductor 16 into the positive input of the amplifier 26. A biasing resistor R4 is coupled between conductor 16 and the main reference voltage conductor 33.

The output of amplifier 26 on conductor 39 is fed back through resistor R2 to the negative input of amplifier 26. The gain of the amplifier is set to be around 15 by choosing resistors R2 and R3. The output of amplifier 26 is coupled to amplifier 27 that is connected in the inverting mode through conductor 39, resistor R5, capacitor C3 into the negative input of amplifier 27. The output of the second amplifier 27 is carried by conductor 41 to an audio tap 42. The output on conductor 41 is fed back to the negative input of amplifier 27 through resistor R6. The gain of the amplifier 27 is set by the resistors R5 and R6 to be approximately 14. The capacitor C3 gives the amplifier 27 a low cut-off (3db) frequency of around 100 hz. This cut-off frequency minimizes the 1/f and "popcorn" noise effects. An audio reference tap 36 connected directly to conductor 33 is provided. It is used in conjunction with the tap 42 to provide the audio signal received from the microphone 12 to other instruments such as transmitters or telephone diallers for transmission to a remote control location, for example, when an alarm occurs. Thus the remote location can listen in on the secured site responsive to an alarm condition. The taps can also be used for tape recording noise in the protected area.

The output of amplifier 27 on conductor 41 is carried by conductor 45 through capacitor C1, resistor R1 into the negative input of the third amplifier 28 connected in its inverting mode.

A feedback path goes from the output conductor 43, conductor 44 through a potentiometer P2 to the negative input of amplifier 28. In a preferred embodiment the potentiometer is a 1 megohm multiturn trimpot. The potentiometer enables the adjustment of the feedback and consequently the detector sensitivity of the system.

Conductor 43 is connected through conductor 44 to the negative input of the comparator 29. The positive input into the comparator 29 is the second reference voltage carried over conductor 46. Thus in this preferred embodiment the comparator compares a reference voltage that is set to be approximately 0.6 volts above the main reference voltage with the output of the third amplifier.

The output of the comparator is normally high. However, significant noises, i.e. noises with values exceeding 0.6 volts at the output of amplifier 28 (used as the threshold in a preferred embodiment) turn the comparator output low. Thus a low output from the comparator indicates significant noises.

Means are provided for obtaining a continuous signal as a function of significant noises. More particularly an envelope detector at the comparator output is provided. The output of the comparator 29 is carried through conductor 47 to envelope detector means shown generally as 49. The envelope detector means comprises a diode D1, a resistor R7 and capacitor C4. The output of comparator 29 is fed through conductor 47 to the cathode of diode D1. The resistor R7 and capacitor C4 are connected in parallel between conductor 51 at the anode of diode D1 and positive voltage. The resistor R7 with capacitor C4 forms a time constant of 10 msecs. This ensures fast transient response while retaining full envelope detection for frequencies above 100 hz.

Means are provided for digitizing the output of the envelope detector. More particularly a pair of inverters shown generally as 48 are used. The input of the first inverter 52 is connected to conductor 51. The output of the first inverter 52 is carried by conductor 53 into the input of inverter 54. The output of inverter 54 appears on conductor 56. It is an active low signal indicated as $\overline{\text{EX-noise}}$. The $\overline{\text{EX-noise}}$ signal also appears on a monitor tap 58 which is connected by conductor 57 to the output of inverter 54 on conductor 56. The monitor tap is used for test and adjusting purposes. Thus with the detector's enclosure closed and sensitivity setting is adjusted using monitor tap 58 and potentiometer P2.

Figure 3:
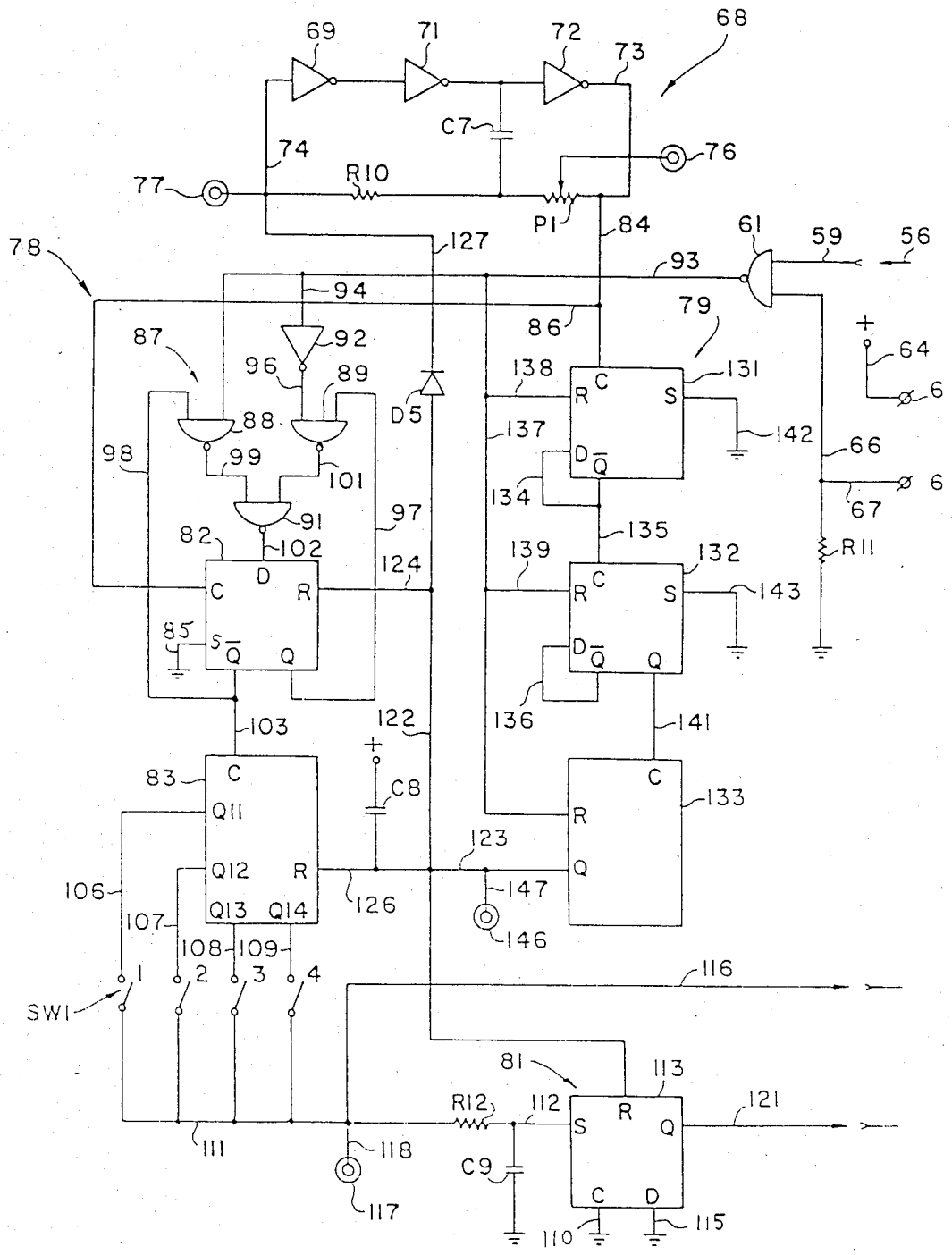
FIG. 3 is a schematic diagram of the noise analysis circuitry of FIG. 1.

The noise analysis circuit is shown in greater detail in FIG. 3 which is a preferred embodiment for implementing the low false alarm rate intrusion detector system.

Coupling means are provided for connecting the output of the significant noise sensing circuit of FIG. 2 into the noise analysis circuit of FIG. 3. The coupling means also provides for connecting the analysis circuitry to any external sensor and especially such a sensor that operates on a signal that can be analysed on a time basis, for example. An example of such a sensor is a vibration detector.

More particularly the input to the noise analysis circuitry comprises a NAND gate 61. One of the inputs to the NAND gate comes from the output of the significant noise sensing circuit and appears on conductor 59 which is connected to conductor 56 of FIG. 2. The other input to the NAND gate is connected through conductor 66 to an external detector which is connected across terminals 62 and 63. Terminal 62 is connected to a positive voltage (Vcc) through conductor 64. Terminal 63 is connected to conductor 66 through conductor 67. Conductor 66 is also connected to ground through resistor R11. The external detector is connected across terminals 62 and 63. In this manner, since the external detector acts as a normally closed dry contact that opens once the detector is activated, it is seen that when the detector is not activated the input to gate 61 is high and when the detector is activated the input at 63 and consequently 66 at the input to NAND gate 61 is pulled down to a logical zero by the resistor R11. Thus when no external detector is used terminals 62 and 63 are shorted together to keep the input on conductor 66 high.

The two inputs, i.e. the $\overline{\text{EX-NOISE}}$ and the external detector input are tied together by the NAND gate 61 so that when either input is activated and is therefore low, the output of the NAND gate 61 goes high. Thus the system can process a signal from an external sensor or detector by the same processing algorithm that is used for processing the noise signal.

The noise analysis circuit comprises oscillator means shown generally as 68. The oscillator means in the preferred embodiment, by way of example, is a three inverter type oscillator. The three inverters are shown as inverters 69, 71 and 72. The frequency is set by means of trimpot P1. In a preferred embodiment the frequency is set to 500 hz.

The inverters are connected in series as shown and the output of inverter 71 is coupled through capacitor C7 to one side of trimpot P1. The other side of trimpot P1 is coupled to the output of the third inverter 72. The wiper of the trimpot is also connected to the output of inverter 72 that appears on conductor 73. The junction point of capacitor C7 and trimpot P1 is coupled through a resistor R10 to the input of the first inverter 69 through a conductor 74. A pair of test points 76 and 77 are provided. Tap 76 is coupled to conductor 73 while tap 77 is conducted to the junction of resistor R10 and conductor 74. The taps 76 and 77 are used to monitor the frequency and to force the output of the oscillator to a higher frequency using an external source, respectively. Forcing the oscillator output to higher frequency speeds the detector's procedures during laboratory testing. The oscillator provides a timing means for measuring the time length of the significant noises.

The output of the oscillator 68 is connected to an accumulated time period counter and an auto-reset time counter. The accumulated noise period counter is shown generally as circuit 78 while the auto-reset time period counter is shown generally as circuit 79. The output of the accumulated noise time period counter 78 is coupled through a delay means including a latching register shown generally as 81.

The accumulated noise period counter 78 comprises a "D" type flip flop shown generally at 82 and a multiple stage binary counter shown as a 14 stage binary counter 83. The clcck input of flip flop circuit 82 is connected to the output of the oscillator 68. More particularly it is connected to conductor 73 through conductor 84 and conductor 86. The D input of the flip flop unit 82 is connected either to its Q output or to its $\overline{Q}$ output as determined by means, such as a multiplexer unit shown generally as 87. The multiplexer unit comprises three NAND gates 88, 89 and 91 and an inverter gate 92. The input to the inverter 92 is connected to conductor 93 which carries the output of NAND gate 61. More particularly the input of inverter gate 92 is coupled to conductor 93 through conductor 94. The output of inverter gate 92 is coupled to one input of NAND gate 89 through conductor 96. The other input of NAND gate 89 is coupled to the Q output of flip flop unit 82 through conductor 97. One input of NAND gate 88 is coupled to the output of NAND gate 61 through conductor 93. The other input of NAND gate 88 is coupled to the $\overline{Q}$ output of flip flop unit 82 through conductor 98. The outputs of NAND gates 88 and 89 are coupled to the inputs of NAND gate 91 through conductors 99 and 101 respectively. The output of NAND gate 91 is coupled through conductor 102 to the D input of flip flop unit 82. The set input of flip flop unit 82 is grounded through conductor 85.

In normal operation, the D input of flip flop 82 is connected to the Q output. Therefore, the flip flop does not change its state. However, whenever a significant noise is received or the external sensor is activated the flip flop D input is switched to the $\overline{Q}$ output. In response to this switching, the flip flop starts to change its state at every pulse received over conductor 86 from the oscillator. In the preferred embodiment the change of state occurs every 2 msecs.

The flip flop's $\overline{Q}$ output is connected to the clock input of the counter circuit 83. Four of the counter's outputs shown as Q11, Q12, Q13 and Q14 are connected to means for selecting an alarm time. More particularly these outputs are connected to switch means SW1, which in the preferred embodiment is a switch of the type known as Dual-In-Line Switch or DIP-Switch. One and only one switch contact is closed at one time. The switch is shown as having four contacts SW1-1, -2, -3 and -4. By operating the switch contacts 1, 2, 3 or 4 the time period is selected as follows: contacts 1-1 selects a time period of 4 secs., contacts 1-2 selects a time period of 8 secs., contacts 1-3 determines a time period of 6 secs., and contacts 1-4 determines a time period of 32 secs. When the set one of these time periods which are the accumulated time limits of significant noises are reached an alarm signal is provided. The time limits can also be varied by varying the oscillator frequency.

The input of switch 1 is carried by conductor 106 from Q11, the input to switch 2 is carried by conductor 107 from Q12, the input of switch 3 is carried by conductor 108 from Q13 and the input of switch 4 is carried by conductor 109 from Q14. The outputs of the switches are all tied together and carried by conductor 111 to resistor R12 and through conductor 112 to the set input of a flip flop circuit serving as the latching register 113. Conductor 112 is tied to ground through capacitor C9. Conductor 111 containing the time criteria is carried to an output conductor 116. A tap 117 also is coupled to conductor 111 through conductor 118. The output of the latching register appears on conductor 121. The output on conductor 116 is an alarm signal while the output on conductor 121 is a delayed alarm signal. These outputs are coupled through the interface circuitry of FIG. 4 to operate selected alarms.

The reset inputs of flip flop 82 and counter 83 are tied together by a conductor 122 that is tied to the output of the auto-reset time period counter 79 that appears on conductor 123. If the time period required for the auto-reset elapses then a high appears on conductor 123 and consequently on conductor 122 to reset flip flop 82 and counter 83 over conductors 124 and 126 respectively. Thus when the output of auto-reset counter 79 goes high the flip flop 82 and the counter 83 are reset. Also the high signal is carried through diode D5 and conductor 127 to the junction of resistor R10 and conductor 74 at the input to inverter 69 to disable the oscillator at the end of a time period determined by the auto-reset circuitry 79. The disabling of the oscillator reduces power consumption of the detector to a minimum and is therefore a valuable feature.

The auto-reset time period counter 79 comprises two flip flops 131 and 132 and a counter unit 133. In the preferred embodiment the counter is a 14 stage binary counter cascaded with the flip flops to form a 16 stage binary counter.

The clock of flip flop unit 131 is coupled directly to the output of the oscillator through conductor 84. The $\overline{Q}$ output of flip flop 131 is coupled to the clock input of flip flop 132 through conductor 135. Output $\overline{Q}$ and input D of flip flop 131 are tied together through conductor 134. Similarly the $\overline{Q}$ output of flip flop unit 132 is tied to its D input through conductor 136. The reset inputs of flip flops 131 and 132 are coupled to the output of NAND gate 61 through conductor 93, conductor 137 and conductors 138 and 139 respectively. The Q output of flip flop 132 is coupled to the clock input of the counter 133 through conductor 141. The set inputs of both flip flops 131 and 133 are coupled to ground over conductors 142 and 143 respectively. The reset input of counter 133 is connected to the output of NAND gate 61 through conductors 93 and 137. The counter 133 starts low in all stages. The last output of the counter goes high after the set time period. In a preferred embodiment the set time period is 65 secs. When the output of counter 133 goes high at the end of the set period then that output disables the oscillator, resets the accumulated noise time period counter and resets the latching register 113. A tap 146 is provided at the output of the counter 133 through conductors 123 and 147. As the oscillator is disabled, the counter stops counting and the output of the counter 133 remains high until the whole auto-reset counter is reset. The reset inputs of the two flip flops 131 and 132 and counter 133 are connected so that any significant noise or external sensor activation signal causes the auto-reset counter to be reset and restarts the counting of the 65 sec. period. Thus repeating noises within the 65 sec. period prevent the auto-reset operation.

Power-on reset means are provided. More particularly capacitor C8 which is connected between the output of the counter and the power supply operates to provide "power-on reset" to the accumulated noise time period counter and to the latching register.

The latching register 113 uses a flip flop circuit connected as a set reset flip flop. The clock and "D" inputs of flip flop unit 113 are grounded through conductors 110 and 115 respectively. Once the output of the alarm time selector turns high the capacitor C9 is charged through resistor R12. The time constant of C9 and R12 in the preferred embodiment, by way of example, is 3.3 secs. Thus after a period of about 2.3 secs. the latching register is set. It remains set until the output of the auto-reset counter turns high and resets the latching register.

Figure 4:
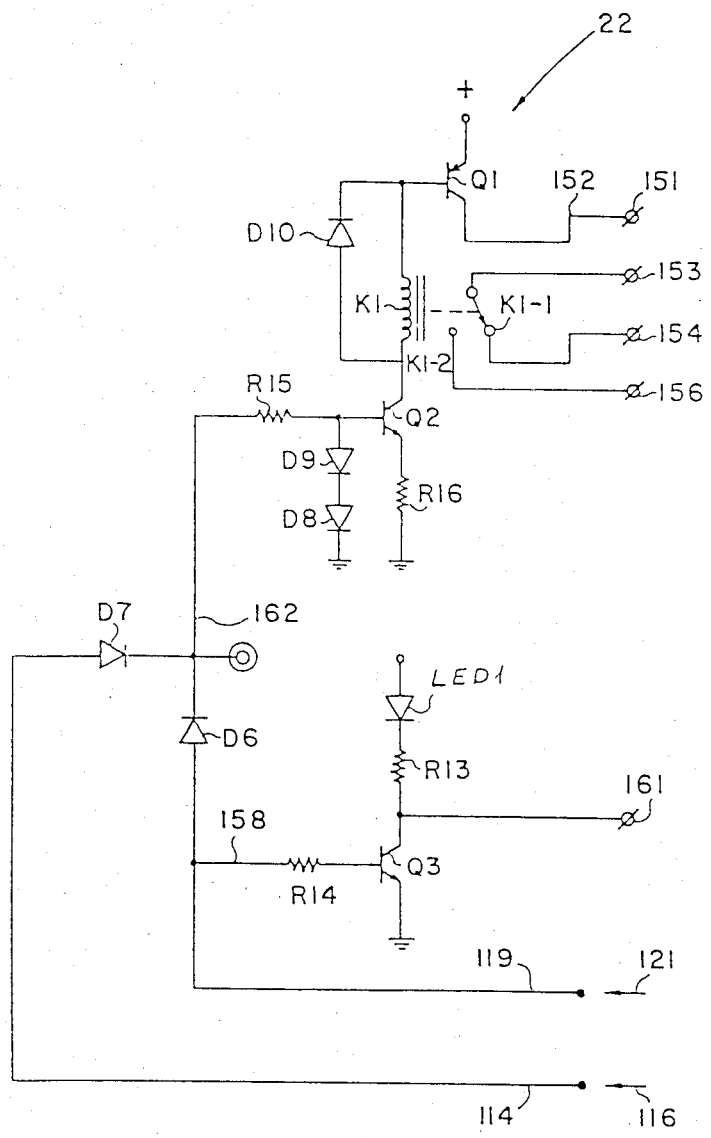
FIG. 4 is a schematic diagram of the output interface circuitry of FIG. 1.

Means are provided for interfacing the output of the noise analysis circuitry with devices that can utilize the signals to provide alarms. More particularly an output interface circuit 22 is provided. The circuit 22 of FIG. 1 is shown in detail in FIG. 4. Among the options shown in FIG. 4 by way of example are a reed relay K1 which is used for limited loads. There is also shown in FIG. 4 a high power PNP transistor Q1 that can be used for example to connect the power supply to an external load such as a wireless transmitter or a telephone dialler. The external load is connected between terminal 151 and the system ground. Conductor 152 goes to the collector of the transistor with the emitter connected to positive voltage. The base of the transistor is connected through the coil of relay K1 NPN transistor Q2, resistor R16 to ground. Diode D10 is connected across the coil of relay K1 to prevent high voltages from appearing at the collector of Q2 when the current through the coil is interrupted. The relay has normally closed contacts K1-1 and normally open contacts K1-2. The normally closed contacts are connected between terminals 153 and 154 while the normally open contacts are connected to terminals 153 and 156 of the output interface circuit.

The output interface circuit is also shown as having a delayed alarm output used, for example, for the delayed triggering of a transmitter after its being turned on. The delayed alarm output is shown as controlled by NPN transistor Q3 having its base connected to the delayed alarm at terminal 119 through conductor 158 and resistor R14. The emitter of transistor Q3 is coupled directly to ground and the collector of transistor Q3 is connected to positive voltage through resistor R13 and an LED diode LED1. A low output is provided at terminal 161 responsive to the operation of transistor Q3. Similarly a high output is provided to output 151 responsive to the operation of transistor Q1.

The delayed alarm signal is received at terminal 119 and is conducted through conductor 157, diode D6, conductor 162 and resistor R15 to the base of transistor Q2. The alarm signal is received from conductor 116 (FIG. 3) and is also conducted to the base of transistor Q2 through conductor 114, diode D7, conductor 162 and resistor R15. When either the alarm signal or the delayed alarm signal is high, transistor Q2 operates. The base of transistor Q2 is coupled to ground through diode chain comprising diodes D9 and D8 connected in series.

Note that when required the same driver which supplies the delayed alarm output also drives the LED. Thus transistor Q3 which supplies the delayed alarm output also enables the operation of the LED to provide a visual alarm.

Transistor Q2 is connected as a current source and drives approximately 40 milliamps through the relay coil K1. This enables the relay to function properly from supply voltages varying from 6 volts D.C. to 12 volts D.C. The current through the relay saturates transistor Q1 and connects the power supply to the power output terminal 151. The relay contacts in a preferred embodiment are rated as 200 volts and 250 milliamps with 3 watts maximum switching power.

The current source transistor Q2 is driven by the alarm or delayed alarm signals. This activates the relay and transistor Q1 right after an alarm is declared before the delayed output is activated.

Thus there is provided an intrusion detector wherein the false alarm rate is minimized. The particular example given with the preferred embodiment uses acoustical noise for sensing the intrusion. However, the circuitry provides for utilizing the system with other types of detectors including vibration type detectors for example. Also while certain examples are given for the output alarms, many types of alarms can be used with the system described herein.

While the principles of the invention have been described above in connection with specific apparatus and applications, it is understood that this description is made by way of example only and not as a limitation on the scope of the invention.

What is claimed is:

1. An intrusion detection system for reliably detecting intrusions into an enclosed area comprising:

detecting means for providing signals indicative of intrusions into said enclosed area;

means for determining significant signals indicative of intrusions above a fixed threshold level;

first means for measuring the time length of each of said significant signals, and for accumulating the measured time lengths of successive significant signals;

means responsive to the accumulated time lengths in said first means reaching a first preselected time length for providing an intrusion-indicating signal;

second means for measuring the time length during which no significant signals are received;

means connected to said second means for resetting said second means, so that the time length measured thereby is reset to zero upon receipt of a significant signal; and means interconnecting said first and second means for resetting said first means, so that the time length accumulated therein is reset to zero when the measured time length in said second means reaches a second preselected time length, whereby an intrusion-indicating signal is provided only when the accumulated time lengths in said first means reach said first preselected time length prior to the time length during which no significant signals are received, which is measured by said second means reaching said second preselected time length.

* * * * *